US006296168B1

(12) United States Patent
Hung

(10) Patent No.: US 6,296,168 B1
(45) Date of Patent: Oct. 2, 2001

(54) ENGAGEMENT STRUCTURE BETWEEN A COVER AND AN END CAP ON A REAR END OF A POWER NAILER

(75) Inventor: Sunking Hung, Taichung (TW)

(73) Assignee: Basso Industry Corp. (TW)

( * ) Notice: Subject to any disclaimer, the term of this patent is extended or adjusted under 35 U.S.C. 154(b) by 0 days.

(21) Appl. No.: 09/760,518

(22) Filed: Jan. 16, 2001

(51) Int. Cl.[7] ..... B25C 1/04
(52) U.S. Cl. ..... 227/130
(58) Field of Search ..... 227/8, 130, 10; 123/465 C

(56) References Cited

U.S. PATENT DOCUMENTS 5,110,030 * 5/1992 Tanji ..... 227/130
5,259,465 * 11/1993 Mukoyama ..... 227/130
5,485,946 * 1/1996 Jankel ..... 227/130
5,715,986 * 2/1998 Sauer ..... 227/130
5,782,395 * 7/1998 Sauer ..... 227/130
5,881,941 * 3/1999 Lai ..... 227/130
5,927,584 * 7/1999 Akiba ..... 227/130
6,059,166 * 5/2000 Ho et al. ..... 227/130

* cited by examiner

*Primary Examiner*—Scott A. Smith
(74) *Attorney, Agent, or Firm*—Charles E. Baxley

(57) ABSTRACT

An exhausted air dispensing device for a power nailer includes an end cap on a rear end of the nailer and an annular recess is defined in a surface of the end cap. A protrusion is located in a center of the annular recess and a plurality of holes are defined radially through the protrusion. An annular groove is defined radially inward in a periphery of the protrusion. A cover has a flange which is engaged with the annular recess in the end cap and an opening is defined radially through the flange. A circular lip extending from a surface of the cover and has an annular hook which is rotatably engaged with the annular groove.

2 Claims, 6 Drawing Sheets

ENGAGEMENT STRUCTURE BETWEEN A COVER AND AN END CAP ON A REAR END OF A POWER NAILER

FIELD OF THE INVENTION

The present invention relates to an exhausted air dispensing device for a pneumatic power nailer wherein a cover is rotatably mounted to an end cap on a rear end of the barrel by engaging an annular hook of the cover with a groove in the end cap of the barrel.

BACKGROUND OF THE INVENTION

A conventional exhausted air dispensing device for a pneumatic power nailer is disclosed in FIG. 1 and includes a cover 13 rotatably mounted to a rear end of the barrel of the power nailer and the cover 13 has a radial opening 12 defined therethrough. An end cap 10 extends from the rear end of the barrel of the power nailer and a hole 11 is defined through the end cap 10 so that the exhausted air ejects from the hole 11. A plurality of bosses 14 extend radially from a root portion of the end cap 10 so as to be received in a groove 15 defined in an inside of the cover 13. Therefore, the cover 13 can be rotated to adjust the position of the opening 12 to prevent the exhausted air together with dust or waste wooden powder from blowing to the user. Besides, because the exhausted air expelled from the holes 11 is so strong so that the cover 13 could not be securely mounted to the end cap 10 and the cover 13 could be loosened so that the position of the radial opening 12 is changed.

The present invention intends to provide an engagement structure between the cover and the end cap of the nailer, which ensures the positioning of the cover.

SUMMARY OF THE INVENTION

In accordance with one aspect of the present invention, there is provided an exhausted air dispensing device for a power nailer and comprising an end cap connected to a rear end of the nailer. An annular recess is defined in a surface of the end cap and a protrusion is located in a center of the annular recess. A plurality of holes are defined radially through the protrusion and an annular groove is defined radially inward in a periphery of the protrusion. A cover has a flange received in the annular recess and an opening is defined radially through the flange. A circular lip extends from a surface of the cover and an annular hook extends radially inward from the circular lip. The annular hook is rotatably engaged with the annular groove.

The primary object of the present invention is to provide a cover which is rotatably and securely mounted to an end cap of the nailer so that the exhausted air from the nailer will not loosen the cover.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
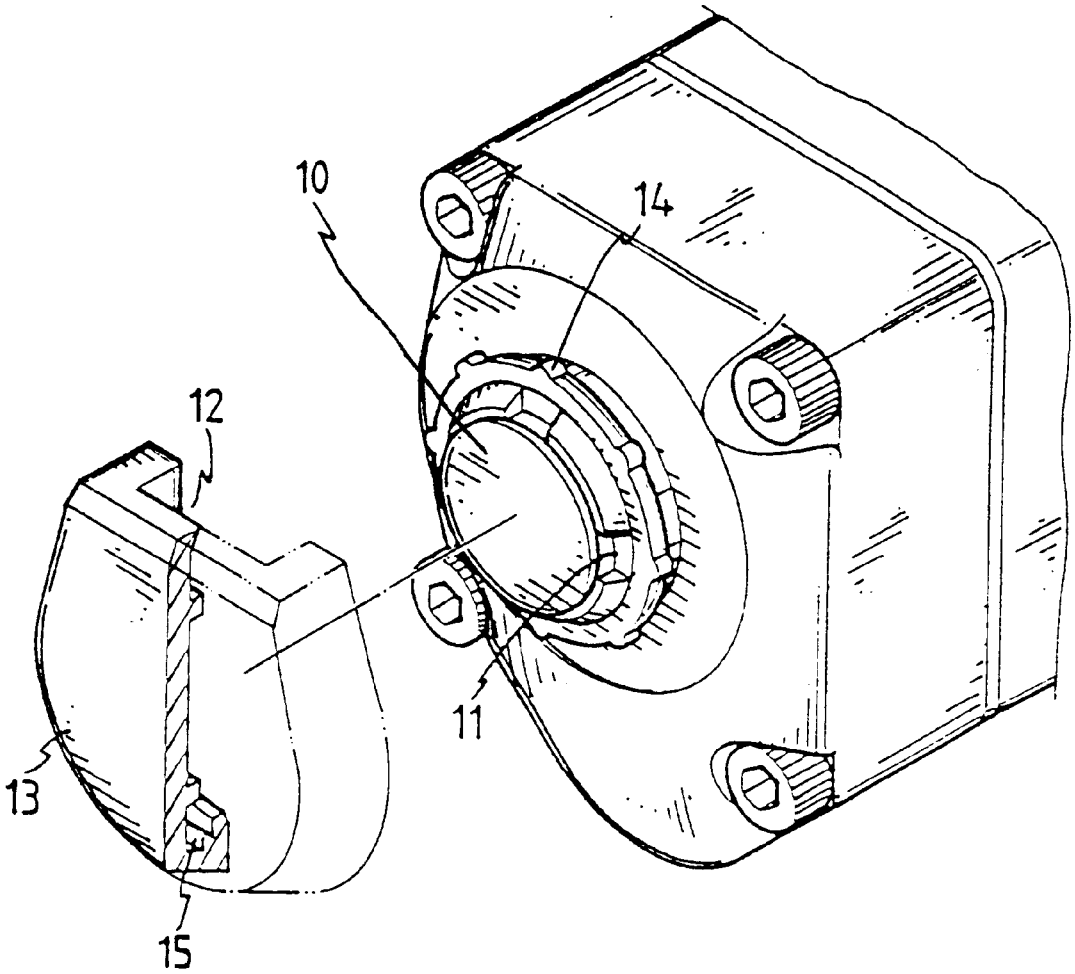
FIG. 1 PRIOR ART
FIG. 1 is an exploded view to show a conventional cover and a conventional power nailer.
Figure 2:
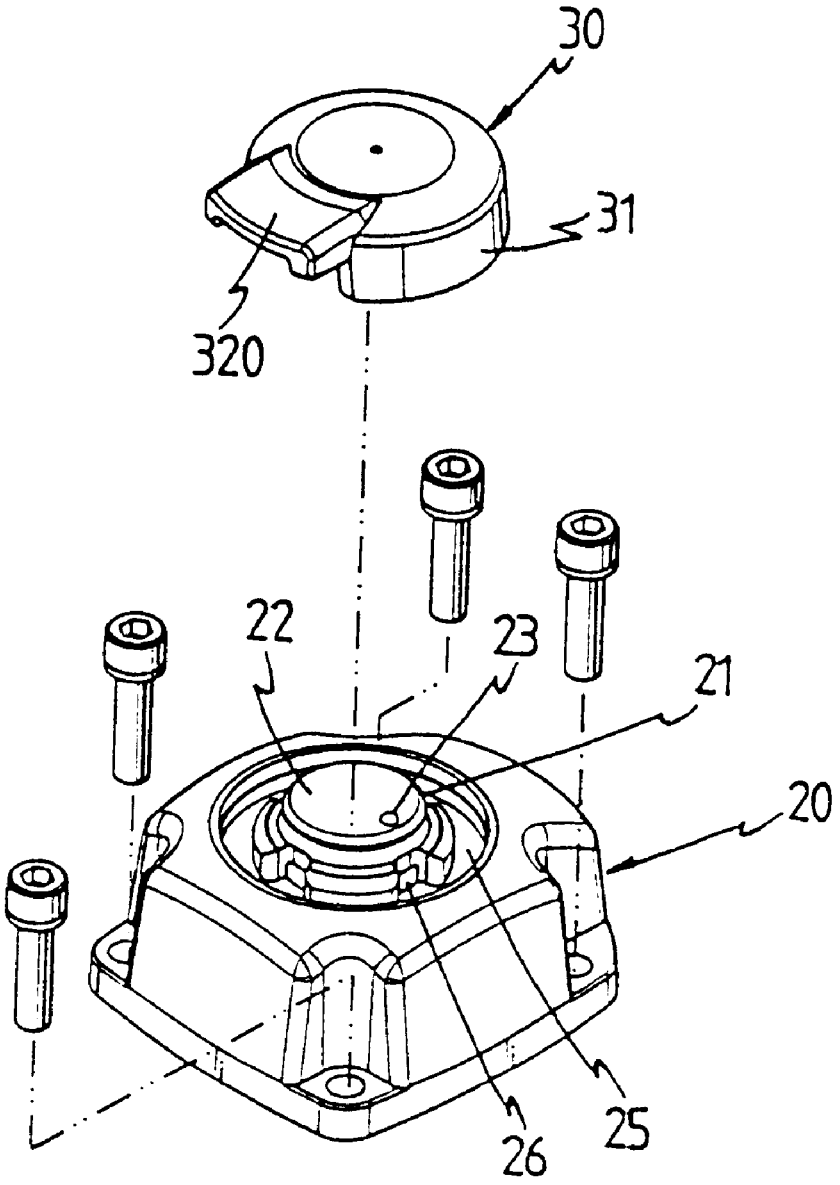
FIG. 2 is an exploded view to show a cover and a power nailer of the present invention.
Figure 3:
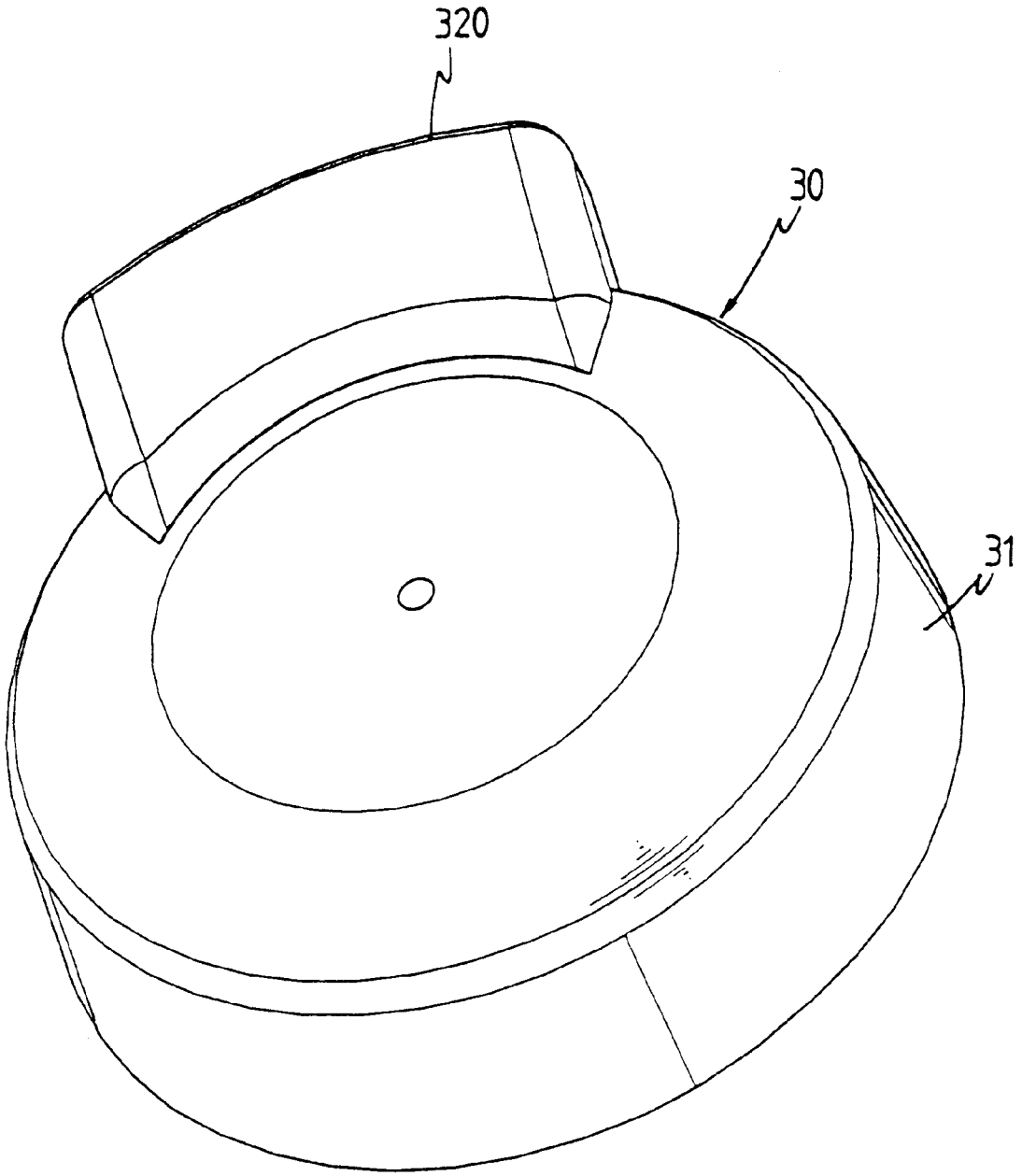
FIG. 3 is a perspective view to show the cover of the present invention.
Figure 4:
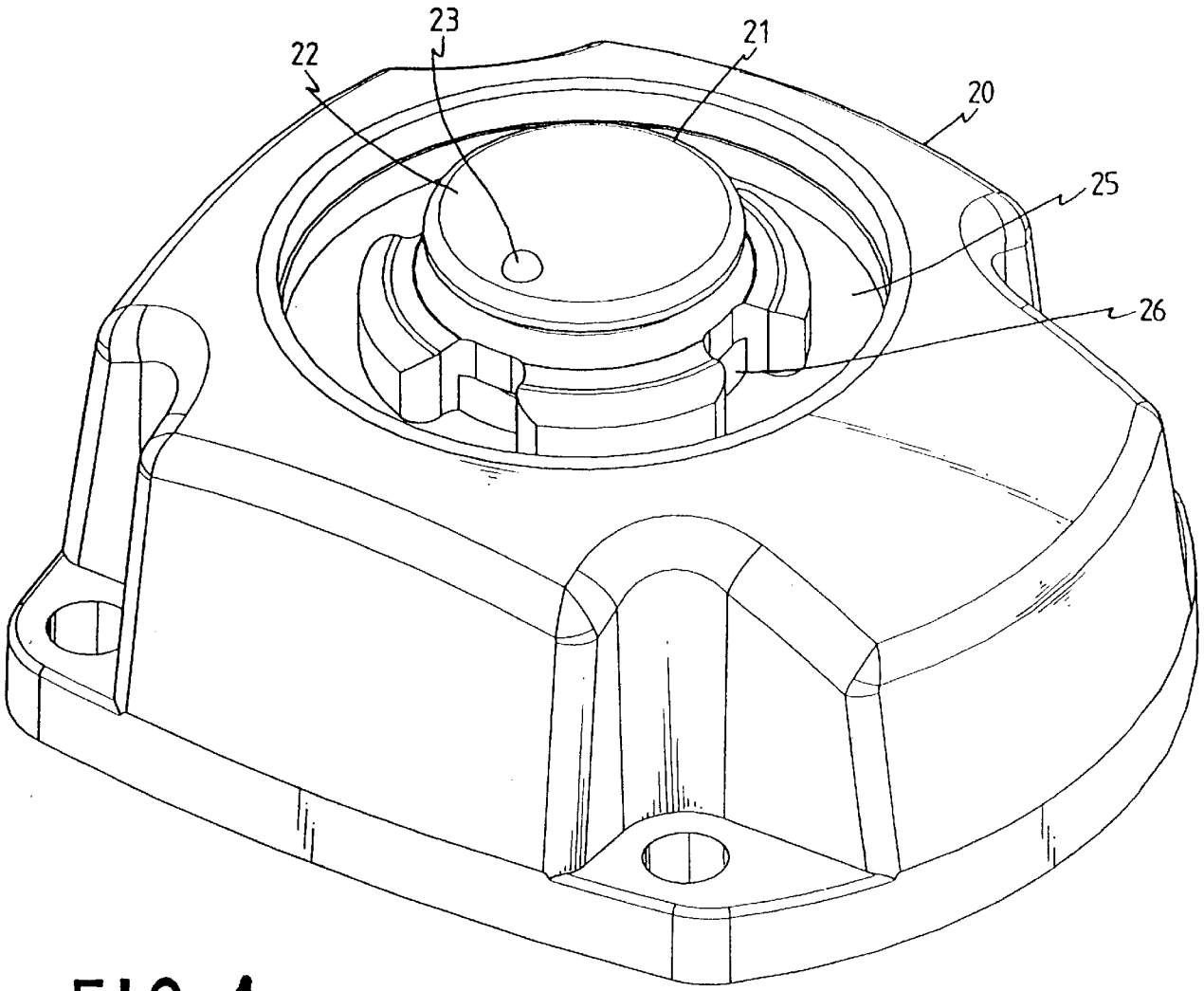
FIG. 4 is a perspective view to show the power nailer of the present invention.
Figure 5:
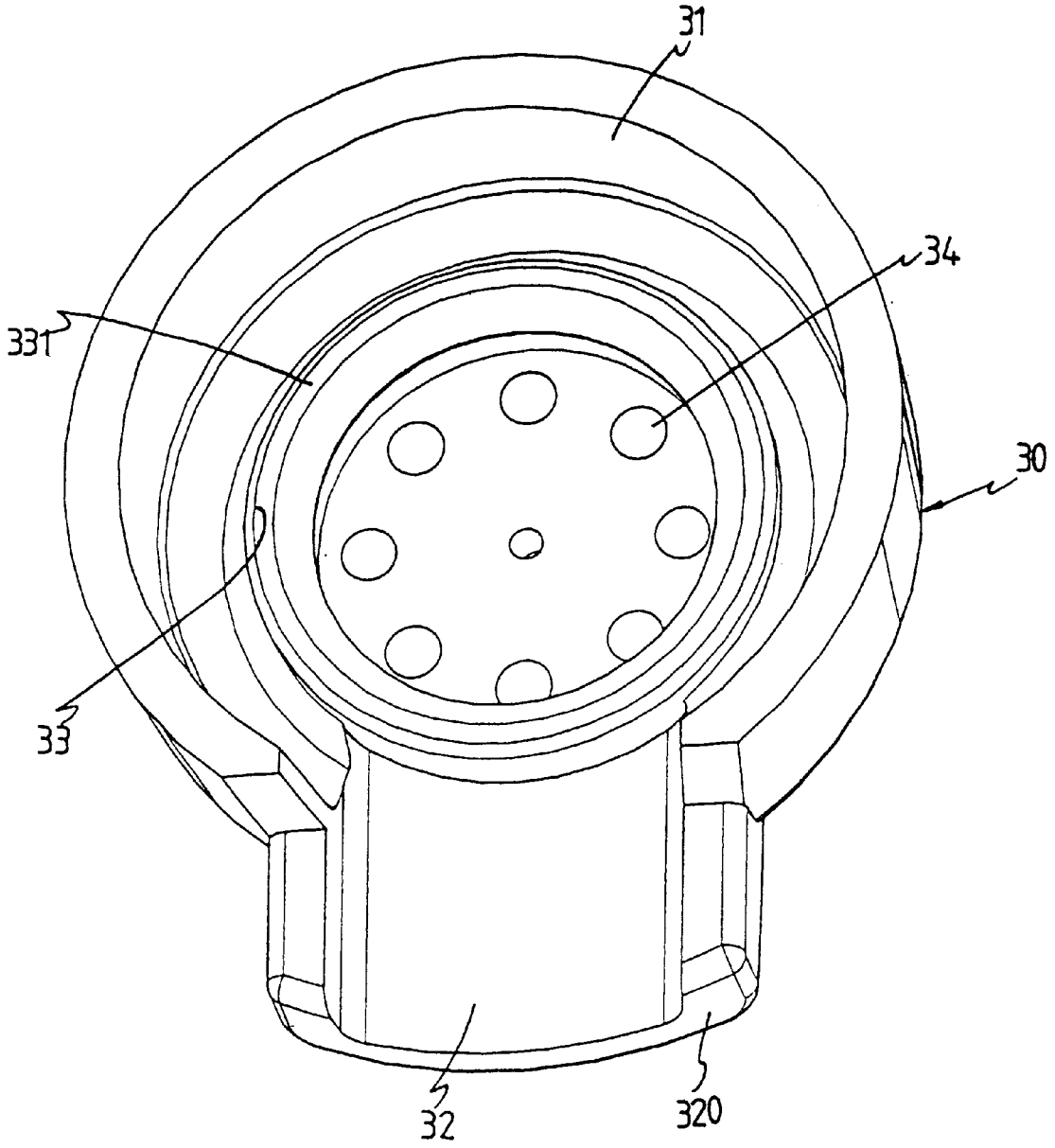
FIG. 5 is a perspective view to show an inside of the cover of the present invention.
Figure 6:
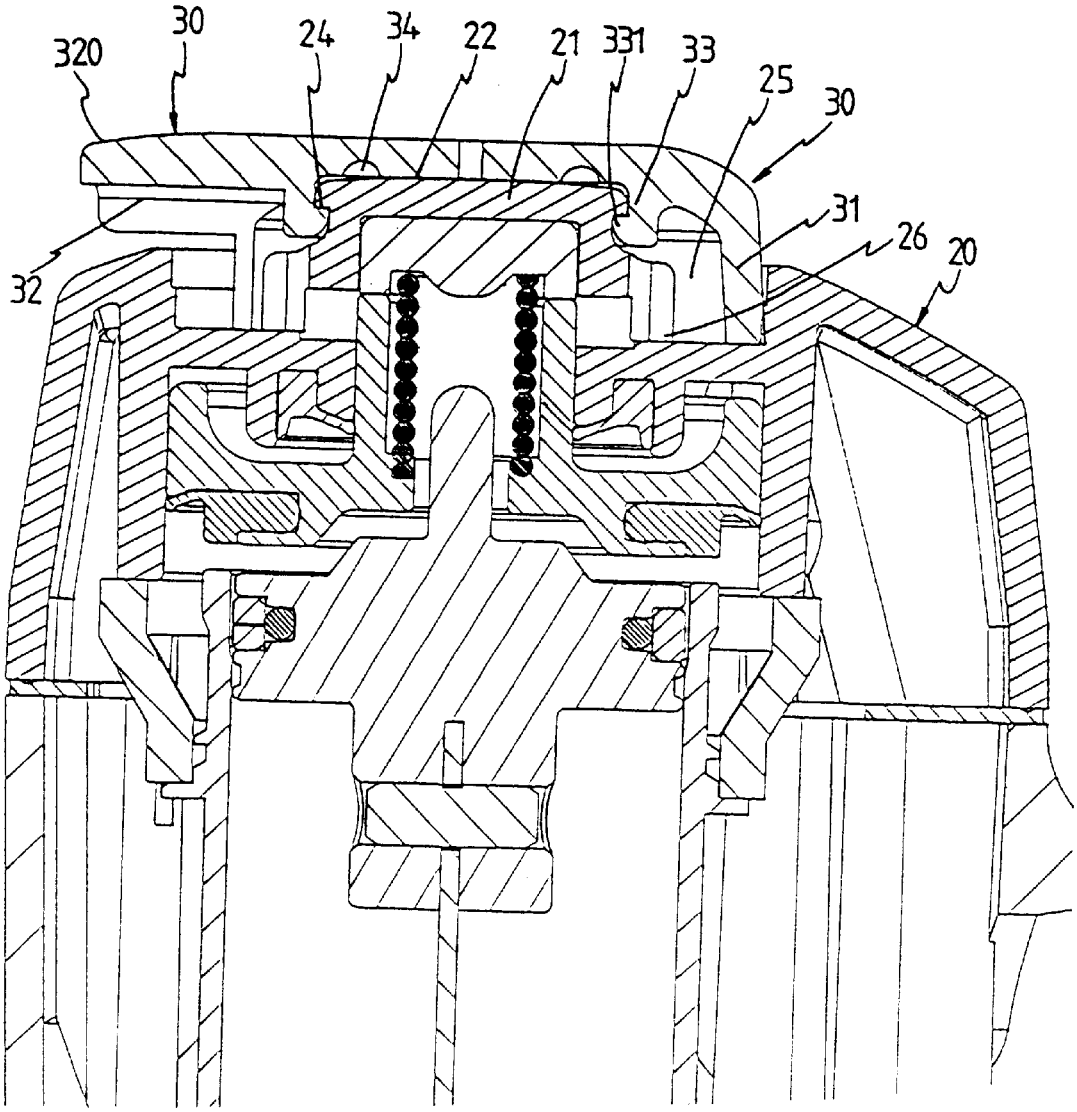
FIG. 6 is a side elevational view to show the assembly of the cover and the power nailer of the present invention.

Referring to FIGS. 2 to 6, the exhausted air dispensing device of the present invention comprises an end cap 20 which is be connected to a rear end of the nailer and an annular recess 25 is defined in a surface of the end cap 20. A protrusion 21 extends from the surface of the end cap 20 and is located in a center of the annular recess 25. A plurality of holes 26 are defined radially through the protrusion 21 so that exhausted air is expelled from these holes 26, the holes 26 communicate with the annular recess 25. An annular groove 24 is defined radially inward in a periphery of the protrusion 21 and a positioning boss 23 extends from a distal end 22 of the protrusion 21.

A cover 30 has a flange 31 extending from a periphery of the cover 30 and an opening 32 is defined radially through the flange 31. A guide plate 320 extends from the flange 31. A circular lip 33 extends from a surface of the cover 30 and an annular hook 331 extends radially inward from the circular lip 33. The flange 31 is received in the annular recess 25 and the annular hook 331 is rotatably engaged with the annular groove 24. A plurality of dents 34 are defined in the surface of the cover 30 and the positioning boss 23 is received in one of the dents 34.

The cover 30 is secured by the engagement of the annular hook 331 and the annular groove 24 so that the expelled exhausted air will not pushed the cover 30 away from the end cap 20. The guide plate 320 guides the air flow to a desired direction. The engagement of the positioning boss 23 and the dents 34 provide an index feature for the user to acknowledge the position of the cover 30.

While we have shown and described various embodiments in accordance with the present invention, it should be clear to those skilled in the art that further embodiments may be made without departing from the scope and spirit of the present invention.

What is claimed is:

1. An exhausted air dispensing device for a power nailer, comprising:

an end cap adapted to be connected to a rear end of said nailer, an annular recess defined in a surface of said end cap and a protrusion located in a center of said annular recess, a plurality of holes defined radially through said protrusion and communicating with said annular recess, an annular groove defined radially inward in a periphery of said protrusion, and a cover having a flange extending from a periphery of said cover and an opening defined radially through said flange, a circular lip extending from a surface of said cover and an annular hook extending radially inward from said circular lip, said flange received in said annular recess and said annular hook rotatably engaged with said annular groove.

2. The device as claimed in claim 1 further comprising a positioning boss extending from a distal end of said protrusion and a plurality of dents defined in said surface of said c over, said positioning boss received in one of said dents.

* * * * *